US009988236B2

(12) United States Patent
Zhu

(10) Patent No.: US 9,988,236 B2
(45) Date of Patent: Jun. 5, 2018

(54) WINDING MACHINE AND WINDING METHOD

(71) Applicant: YOUCNC MACHINING LIMITED, Shenzhen (CN)

(72) Inventor: Chengyi Zhu, Shenzhen (CN)

(73) Assignee: YOUCNC MACHINING LIMITED (CN)

( * ) Notice: Subject to any disclaimer, the term of this patent is extended or adjusted under 35 U.S.C. 154(b) by 743 days.

(21) Appl. No.: 14/666,402

(22) Filed: Mar. 24, 2015

(65) Prior Publication Data

US 2016/0172106 A1 Jun. 16, 2016

(30) Foreign Application Priority Data

Dec. 15, 2014 (CN) ..... 2014 1 0775685

(51) Int. Cl.
*B65H 81/00* (2006.01)
*H01F 41/082* (2016.01)
*H01F 41/09* (2016.01)

(52) U.S. Cl.
CPC ..... *B65H 81/00* (2013.01); *H01F 41/082* (2016.01); *H01F 41/09* (2016.01)

(58) Field of Classification Search
CPC ..... B65H 81/00; H01F 41/082; H01F 41/09; H01F 41/069; H02K 15/00; B29C 53/56; B21C 47/00
See application file for complete search history.

(56) References Cited

U.S. PATENT DOCUMENTS 3,341,387 A * 9/1967 Boggs ..... B29C 53/60 156/175
3,759,454 A * 9/1973 Bernard ..... H01R 43/033 242/439.1
4,664,329 A * 5/1987 Pali ..... B21C 47/00 242/362.1
4,903,384 A * 2/1990 Lange ..... B21C 47/00 140/58
6,375,113 B1 * 4/2002 Ishimaru ..... H01F 41/082 242/445.1
9,359,045 B2 * 6/2016 Nam ..... B66D 1/14
9,663,336 B2 * 5/2017 Roodenburg ..... B66D 1/26
(Continued)

*Primary Examiner* — Michael E Gallion
(74) *Attorney, Agent, or Firm* — Garcia-Zamor IP Law; Ruy M. Garcia-Zamor

(57) ABSTRACT

The present invention discloses a winding machine, which including a conveying-wire device, a pressing-wire device, a first mold, a first mold core, a second mold, a second mold core, a placing mold device and a plate. The conveying-wire device conveys a wire to a first predefined position. The placing mold device places the plate on the first mold core. The first mold engages with the second mold to press the plate. The pressing-wire device clamps the wire when the conveying-wire device releases the wire. The first mold core and the second mold core wind the coils respectively. The present invention also discloses a winding method. The winding machine and the winding method use the first mold core and the second mold core to wind coils simultaneously, wherein a structure of the winding machine is simple, and implementation and operation are convenient, resulting in improving the efficiency of the winding machine.

18 Claims, 10 Drawing Sheets

(56) References Cited

U.S. PATENT DOCUMENTS

| | | | | |
|---|---|---|---|---|
| 2002/0030134 | A1* | 3/2002 | Sugiuchi | H01F 41/076 242/445.1 |
| 2016/0049239 | A1* | 2/2016 | Sugimoto | H01F 41/04 242/443 |
| 2016/0061309 | A1* | 3/2016 | Tan | B65H 81/00 242/430 |
| 2016/0076874 | A1* | 3/2016 | Corradini | B29C 70/32 242/443 |
| 2016/0126815 | A1* | 5/2016 | Ponzio | H02K 15/095 242/440 |
| 2016/0172106 | A1* | 6/2016 | Zhu | B65H 81/00 242/445 |
| 2018/0053599 | A1* | 2/2018 | Kanno | H01F 41/04 |

* cited by examiner

WINDING MACHINE AND WINDING METHOD

BACKGROUND

This application claims priority to a Chinese Patent Application CN 201410775685.7 filed Dec. 15, 2014; the above-identified application is hereby incorporated by reference in its entirety as if fully set forth herein.

BACKGROUND

1. Technical Field

The present invention relates to a winding machine, and especially to a winding machine and a winding method for winding N groups coils.

2. Description of Related Art

A transformer is need in the general electronics, such as a mobile phone, a computer and so on. A plurality of coils are simultaneously used in a multi-power transformer to improve a power of the transformer. However, when a traditional winding machine winds coils, a wire is feed in one direction and winded by a single winding shaft, resulting in only one single coil being winded in one time and inconvenience because the single coils must be connected together during using. Simultaneously, because a single coil is winded in one time, the efficiency of winding coils of a winding machine is low.

SUMMARY

The object of the present invention is to provide a winding machine and a winding method for winding N groups coils in one time.

To solve the above problems, the present invention provides a technical solution as following.

In one aspect, the present invention provides a winding machine for winding N groups coils, comprising:

a conveying-wire device for clamping a wire and arriving to a first predefined position;

a pressing-wire device clamping the wire when the conveying-wire device releases the wires;

a first mold comprising a first mold core;

a plate;

a placing mold device for placing the plate on the first mold core or taking out the plate from the first mold core; and a second mold comprising a second mold core, wherein the second mold engages with or disengages from the first mold to press or release the plate;

wherein during winding, the second mold core winds a first coil of each group of the N groups coils, and the first mold core winds a second coil of each group of the N groups coils, and wherein the first mold core moves relative to the first mold to drop down each the second coil, and the second mold core moves relative to the second mold to drop down each the first coil, wherein N is an integer greater than or equal to 1.

Preferably, the winding machine comprises a fork shaft and a fork, wherein during winding, the wire arrives to the fork through the fork shaft, and the conveying-wire device moves to the fork for clamping the wire and moves opposite from the fork to the first predefined position.

Preferably, the winding machine comprises a first main shaft and a second main shaft, wherein the fork shaft is disposed on the first main shaft, and the first mold is rotatable disposed on the fork shaft, and wherein the second mold is disposed on the second main shaft, and the first mold core is disposed on the fork shaft, and the second mold core is disposed on the second main shaft.

Preferably, the first mold core and the second mold core rotate in the same direction, and a rotate speed of the first mold core is twice a rotate speed of the second mold core.

Preferably, the plate comprises a body, a first groove and a second groove, wherein the first groove and the second groove are disposed on two opposite sides of the body respectively, and wherein a part of the first mold core is accommodated in the first groove, and a part of the second mold core is accommodated in the second groove.

Preferably, a shape of the first groove is consistent with a cross-sectional shape of the first mold core, and a shape of the second groove is consistent with a cross-sectional shape of the second mold core.

Preferably, the plate has a wire groove, which is disposed on a lower end of the body and in communication with the first groove and the second groove.

Preferably, the winding machine comprises a positioning device for positioning the first mold core, and wherein the positioning device comprises a first gear, a second gear, a positioning shaft and a positioning motor, wherein the first gear is disposed on the fork shaft, and the second gear is disposed on the positioning shaft and engages with the first gear, and wherein the positioning motor drives the rotation of the positioning shaft.

Preferably, the positioning device comprises a positioning cylinder, wherein the positioning cylinder drives the positioning motor to move to a position just below the fork shaft, and the positioning motor drives the rotation of the second gear, and wherein the positioning cylinder moves up to make the first gear and the second gear engage and rotate synchronously.

Preferably, the placing mold device comprises a first cylinder, a second cylinder, a third cylinder, a fourth cylinder and a clamping portion for clamping the plate, wherein the first cylinder drives the clamping portion to move up and down, and the second cylinder drives the clamping portion to move left and right, and wherein the third cylinder drives the clamping portion to move forward and backward, and the fourth cylinder drives the clamping portion to clamp or put down the plate.

Preferably, the winding machine comprises a cutting-wire device, for cutting the wire after the N groups coils have been winded.

Preferably, the winding machine comprises a first motor, a second motor, a clamping-mold motor and a conveying-wire motor, wherein the first motor drives the first main shaft to rotate, and the second motor drives the second main shaft to rotate, and wherein the clamping-mold motor drives the first mold to engage with the second mold, and the conveying-wire motor drives the conveying-wire device to move.

In another aspect, the present invention provides a winding method for winding N groups coils, comprising:

a conveying-wire device clamping a head of a wire and moving to a first predefined position;

a placing mold device placing a plate on a first mold core of a first mold;

a second mold engaging with the first mold to press the plate;

a pressing-wire device clamping the wire when the conveying-wire device releases the head of the wire;

a second mold core winding a first coil of a first group of the N groups coils, and the first mold core winding a second coil of the first group of the N groups coils;

the placing mold device clamping the plate, wherein the first mold disengages from the second mold;

the conveying-wire device clamping the wire which has winded the first group of the N groups coils;

the first mold core of the first mold disengaging from the second mold core of the second mold, wherein the conveying-wire device moves to a second predefined position; and repeating all steps of winding the first group of the N groups coils until a Nth group of the N groups coils has been winded;

wherein N is an integer greater than or equal to 1.

Preferably, before the conveying-wire device clamps the head of the wire, the wire arrives to a fork through a fork shaft, wherein the conveying-wire device moves to the fork and clamps the head of the wire.

Preferably, rotate directions of the first mold core and the second mold core are the same, and a rotate speed of the first mold core is twice a rotate speed of the second mold core.

Preferably, before the placing mold device places the plate on the first mold core of the first mold, a positioning device positions the first mold core.

Preferably, after the pressing-wire device clamps the wire when the conveying-wire device releases the head of the wire, the positioning device and the placing mold device return to a starting position.

Preferably, when winding a Kth group of the N groups coils, a (K−1)th group of the N groups coils arrives to the pressing-wire device and the conveying-wire device clamps the wire, wherein after the pressing-wire device opens and moves down, the conveying-wire device moves forward until the Kth group of the N groups coils has been winded, wherein K is an integer greater than or equal to 2 and less than or equal to N.

The present invention provides a winding machine and a winding method, wherein the winding machine of the present invention can wind coils in two directions simultaneously and actualize synchronization winding accurately by using the first mold core and the second mold core to wind coils simultaneously, thus a structure of the winding machine is simple, and the implementation and operation are convenient, further resulting in improving the efficiency of the winding machine, and increasing more convenience to the industry.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The technical solution of the embodiment of the present invention will be described clearly and completely by referring to the accompanying drawing of the embodiments of the present invention.

Figure 1:
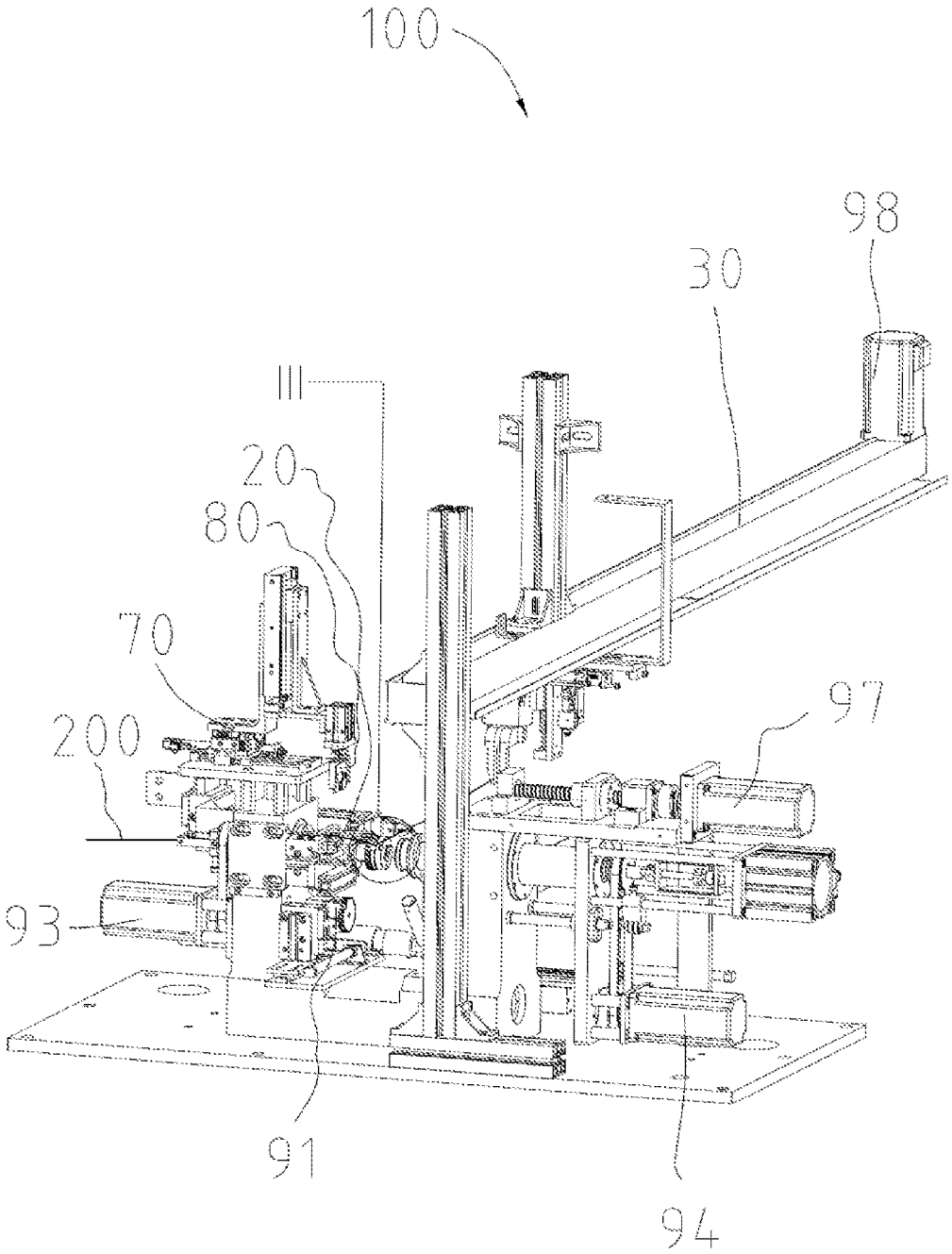
FIG. 1 is an assembled view of a winding machine of the present invention.

Please referring to FIG. 1, the present invention provides a winding machine 100 for winding N groups coils, wherein N is an integer greater than or equal to 1. Please referring to FIG. 1 to FIG. 4, the winding machine 100 includes a fork shaft 10, a fork 20, a conveying-wire device 30, a pressing-wire device 40, a first mold 50, a second mold 60, a placing mold device 70 and a plate 80. The first mold 50 includes a first mold core 52 for winding coils, and the second mold 60 includes a second mold core 62 for winding coils. During winding, the conveying-wire device 30 moves to the fork 20 for clamping a wire 200 and arrives to a first predefined position opposite from the fork 20. The placing mold device 70 is used for placing the plate 80 on the first mold core 52 or taking out the plate 80 from the first mold core 52. The second mold 60 engages with or disengages from the first mold 50 to press or release the plate 80. The pressing-wire device 40 clamps the wires 200 between the conveying-wire device 30 and the forks 20 when the conveying-wire device 30 releases the wire 200. The second mold core 62 winds a first coil of each group of the N groups coils, and the first mold core 52 winds a second coil of each group of the N groups coils. The first mold core 52 moves relative to the first mold 50 to drop down each the second coil, and the second mold core 62 moves relative to the second mold 60 to drop down each the first coil.

In the embodiment, a distance between a starting position of the conveying-wire device 30 and the first predefined position is equal to a length of the wire 200 which is need for winding a first coil of a first group of the N groups coils. The starting position of the conveying-wire device 30 is a position the conveying-wire device 30 starts to move.

During winding, the wire 200 arrives to the fork 20 through the fork shaft 10. The conveying-wire device 30 moves to the fork 20 for clamping a head of the wire 200 and moves opposite from the fork 20 to the first predefined position. The placing mold device 70 is used for placing the plate 80 on the first mold core 52. The second mold 60 engages with the first mold 50 to press the plate 80. The pressing-wire device 40 clamps the wires 200 between the conveying-wire device 30 and the fork 20, and the conveying-wire device 30 releases the head of the wire 200. The second mold core 62 winds the first coil of the first group of the N groups coils, and the first mold core 52 winds the second coil of the first group of the N groups coils. The placing mold device 70 clamps the plate 80. The first mold 50 disengages from the second mold 60, and the conveying-wire device 30 moves to the fork 20 and clamps the wires 200 which has winded the first group of the N groups coils. The first mold core 52 moves relative to the first mold 50 to drop down the second coil of the first group of the N groups coils and the second mold core 62 moves relative to the second mold 60 to drop down the first coil of the first group of the N groups coils, and the conveying-wire device 30 moves to a second predefined position, wherein a distance between the starting position of the conveying-wire device 30 and the second predefined position is equal to a length of a wire 200 which is need for winding a first coil of a second group of the N groups coils, repeating the winding steps of the first group of the N groups coils until after winding a Nth group of the N group coils, wherein N is an integer greater than or equal to 1.

The winding machine 100 of the present invention uses the first mold core 52 and the second mold core 62 to wind coils at the same time, that is the winding machine 100 of the present invention can wind coils in two directions simultaneously and actualize synchronization winding accurately, thus a structure of the winding machine 100 is simple, and the implementation and operation are convenient, further resulting in improving the efficiency of the winding machine 100, and increasing more convenience for the industry.

Further more, the winding machine 100 can wind a plurality of groups coils, thus the plurality of groups coils can be used in a transformer directly, rather than a plurality of single coils must be connected together for being used in the transformer, which greatly improve the convenience of use for the user, and further solve the problem of inconvenience caused by winding a single coil in one time and needing to connect a plurality of single coils to use them in the transformer in the prior art.

In one embodiment, the fork shaft 10 includes a threading orifice, and the fork 20 includes a wire shaft 22 disposed on its end. The wire 200 moves from one end of the threading orifice to the other end of the threading orifice and arrives to the wire shaft 22.

The winding machine 100 also includes a first main shaft 95 and a second main shaft 96. The fork shaft 10 is disposed on the first main shaft 95. The first mold 50 is disposed on the fork shaft 10. The second mold 60 is disposed on the second main shaft 96. The first mold core 52 is disposed on the fork shaft 10, and the second mold core 62 is disposed on the second main shaft 96. During winding, the first main shaft 95 and the second main shaft 96 rotate in the same direction, and the rotate speed of the first main shaft 95 is twice the rotate speed of the second main shaft 96, that is, the first mold core 52 and the second mold core 62 rotate in the same direction, and the rotate speed of the first mold core 52 is twice the rotate speed of the second mold core 62.

In one embodiment, the fork shaft 10 is fastened to the first main shaft 95.

Because the rotate speed of the first mold core 52 is twice the rotate speed of the second mold core 62, both the first and the second coils of each group can be winded synchronously and accurately.

In one embodiment, the first mold core 52 can retract within the first mold 50, and the second mold core 62 can retract within the second mold 60. During using, after one group of the N groups coils has been winded, the first mold core 52 retracts within the first mold 50, and the second mold core 62 retracts within the second mold 60, that is the first mold core 52 moves relative to the first mold 50 and the second mold core 62 moves relative to the second mold 60 to drop down the first group of the N groups coils which has been winded. After the first group of the N groups coils which has been winded is dropped down, the first mold core 52 protrudes from the first mold 50, and the second mold core 62 protrudes from the second mold 60, to prepare winding next group of the N groups coils.

Please referring to FIG. 3 to FIG. 6, the plate 80 includes a body 82, a first groove 81 and a second groove 83. The first groove 81 and the second groove 83 are disposed on two opposite sides of the body 82 respectively. A part of the first mold core 52 is accommodated in the first groove 81, and a part of the second mold core 62 is accommodated in the second groove 83. The first groove 81 and the second groove 83 are both circular, and cross-sections of the first mold core 52 and the second mold core 62 are both circular.

In other embodiments, the first groove 81 and the second groove 83 are both square or other shapes, and the cross-sections of the first mold core 52 and the second mold core 62 are both square or other shapes, that is, a shape of the first groove 81 is consistent with a cross-sectional shape of the first mold core, and a shape of the second groove 83 is consistent with a cross-sectional shape of the second mold core 62. As the first mold core 52 and the second mold core 62 are non-circular, the winding machine 100 includes a positioning device 91, for positioning the first mold core 52, that is, as the first mold core 52 is non-circular, a outline of the first mold core 52 needs to be one-to-one corresponded with a outline of the first groove 81 to make the first mold core 52 be accommodated in the first groove 81, so the positioning device 91 is needed to position the first mold core 52 to make the outline of the first mold core 52 corresponding with the outline of the first groove 81, then the first mold core 52 is accommodated in the first groove 81.

In one embodiment, the correspondence of outlines between the second mold core 62 and the second groove 83 is realized by controller (not shown). As the second groove 83 and the second mold core 62 are non-circular, a outline of the second mold core 62 needs to be one-to-one corresponded with a outline of the second groove 83 to make the second mold core 62 be accommodated in the second groove 83. The controller controls the outline of the second mold core 62 to make the second mold core 62 be accommodated in the second groove 83.

The plate 80 has a wire groove 85, which is disposed on a lower end of the body 82 and connected with the first groove 81 and the second groove 83.

The winding machine 100 can wind two coils in one time because of the plate 80 being disposed between the first mold core 52 and the second mold core 62, and the efficiency of the winding machine 100 is improved.

Figure 2:
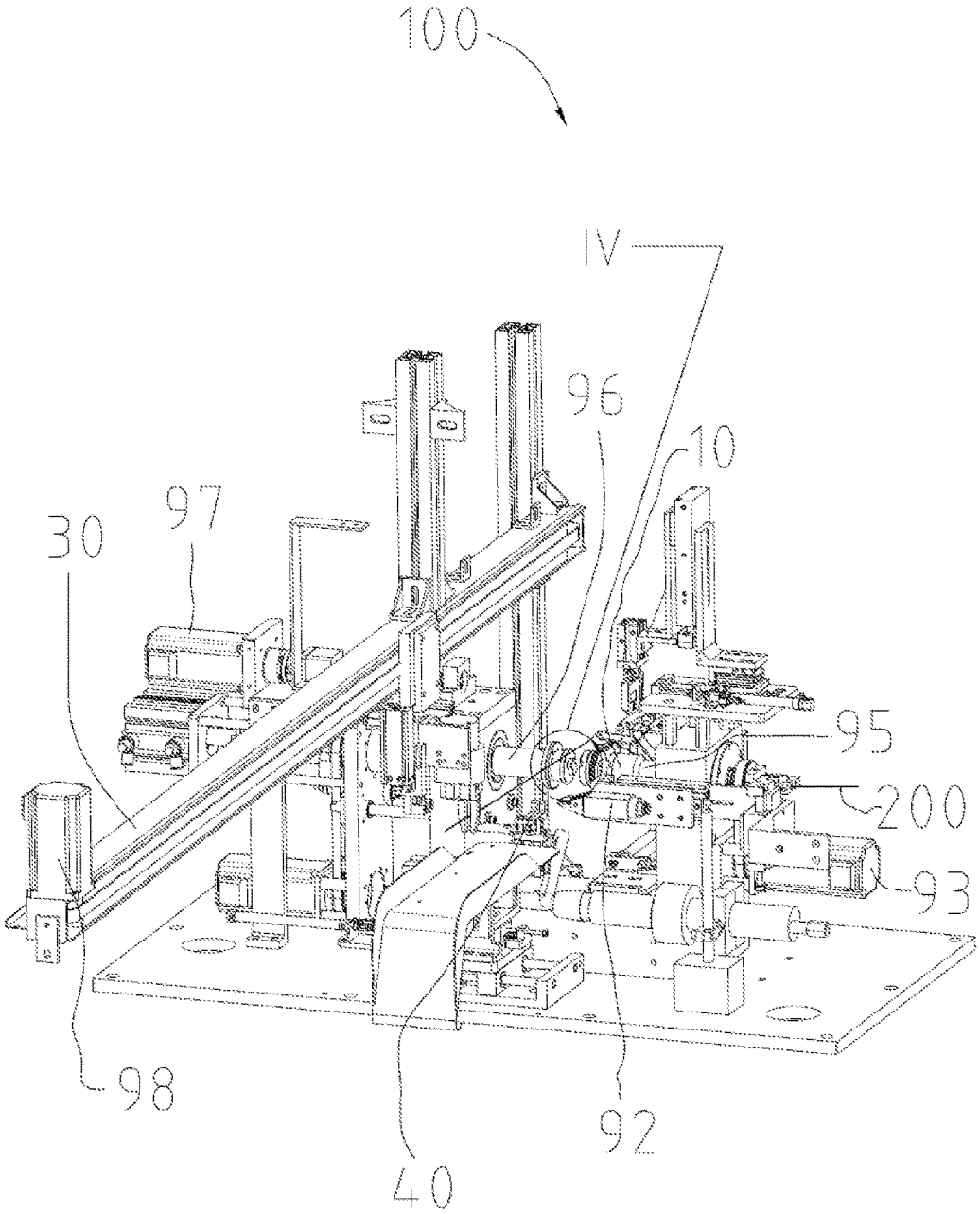
FIG. 2 is an assembled view of a winding machine of the present invention, but viewed from another aspect.
Figure 3:
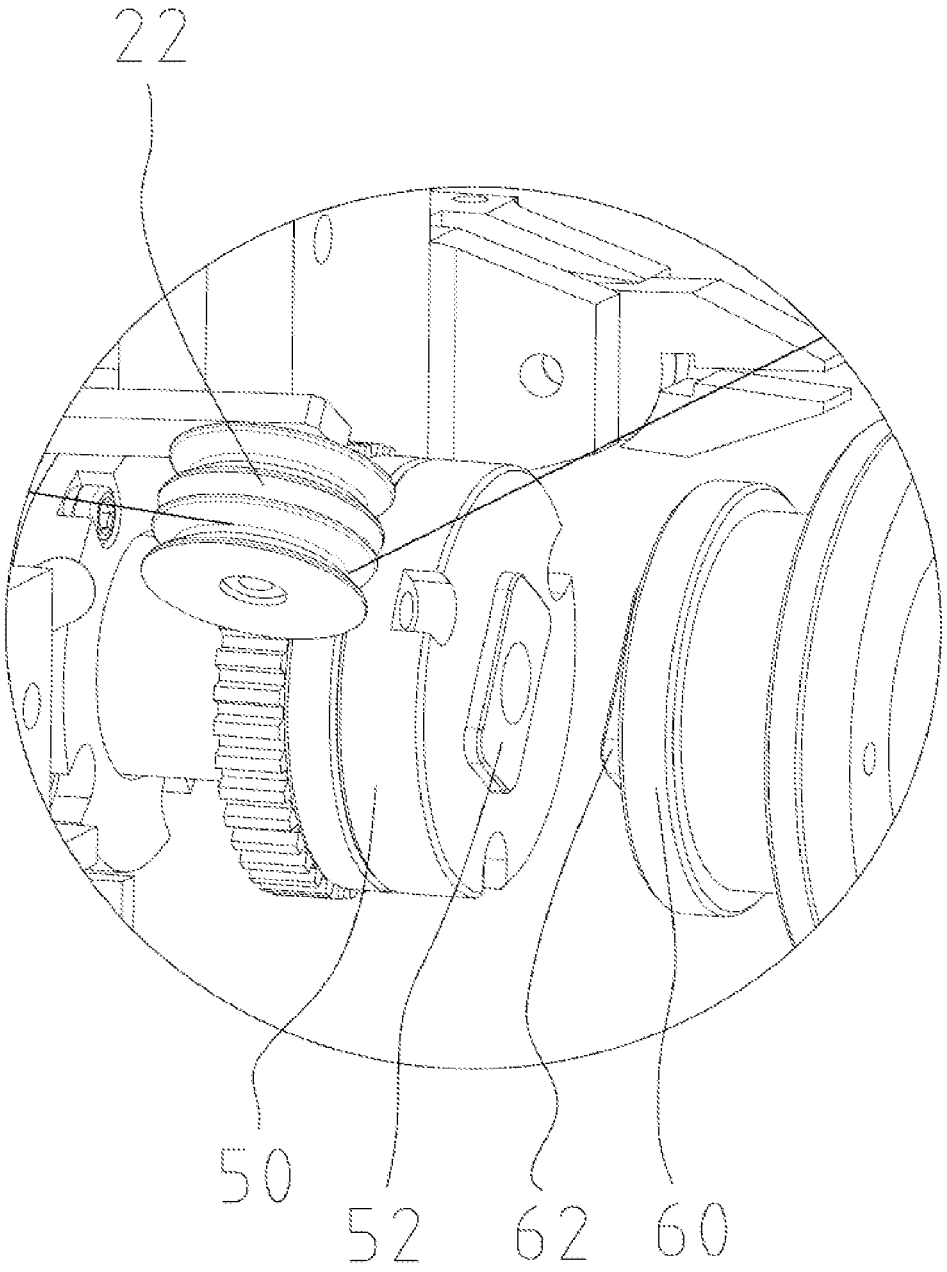
FIG. 3 is an enlarged view of a circle portion III of FIG. 1.
Figure 4:
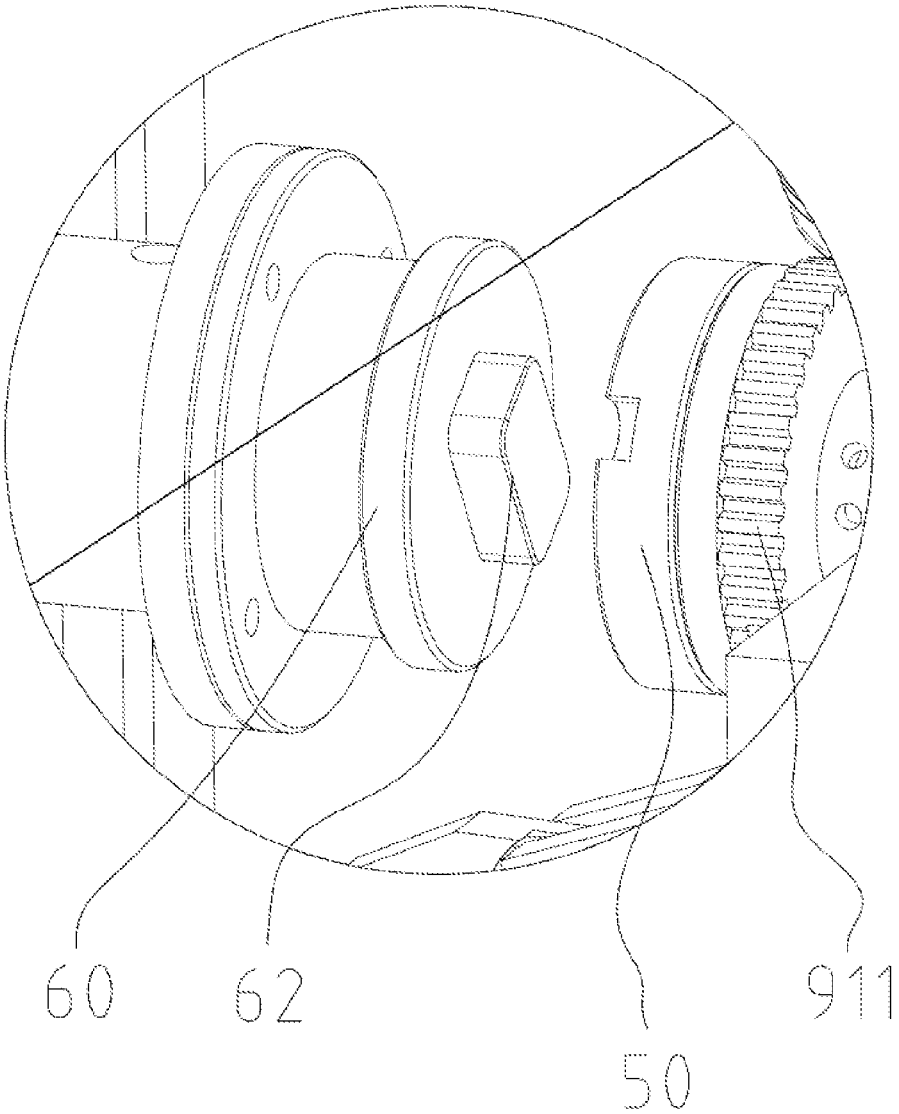
FIG. 4 is an enlarged view of a circle portion IV of FIG. 1.
Figure 5:
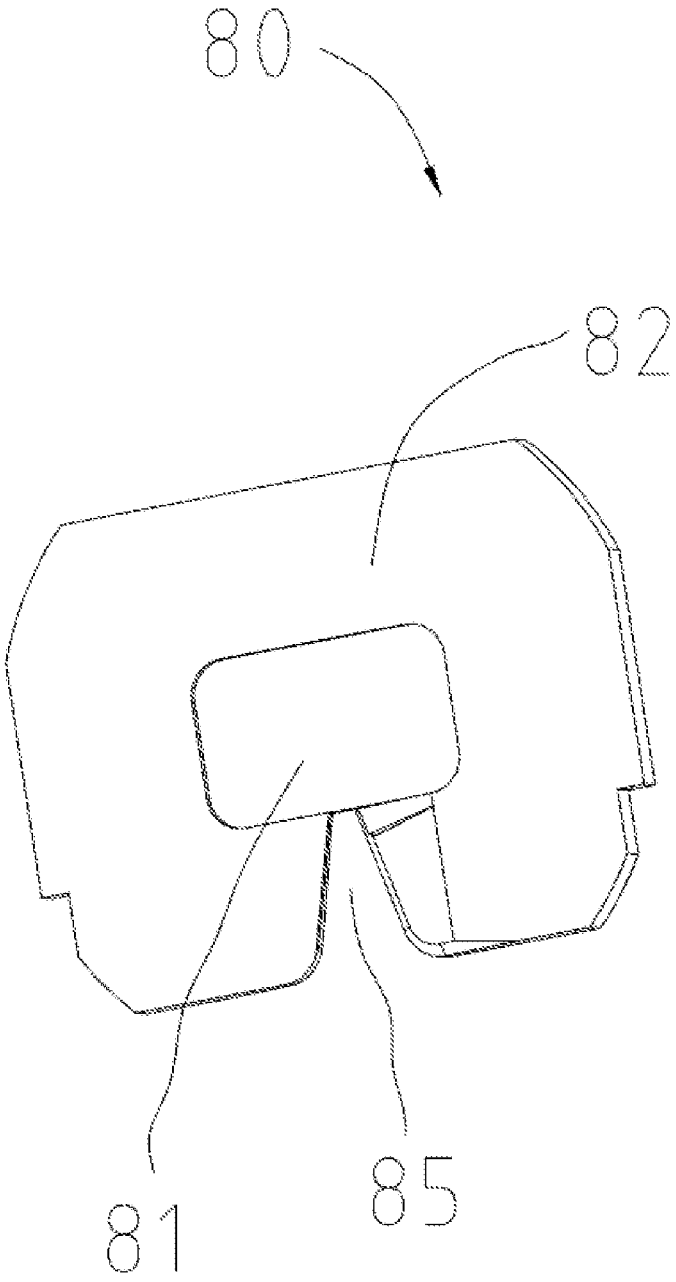
FIG. 5 is a perspective view of a plate of FIG. 1.
Figure 6:
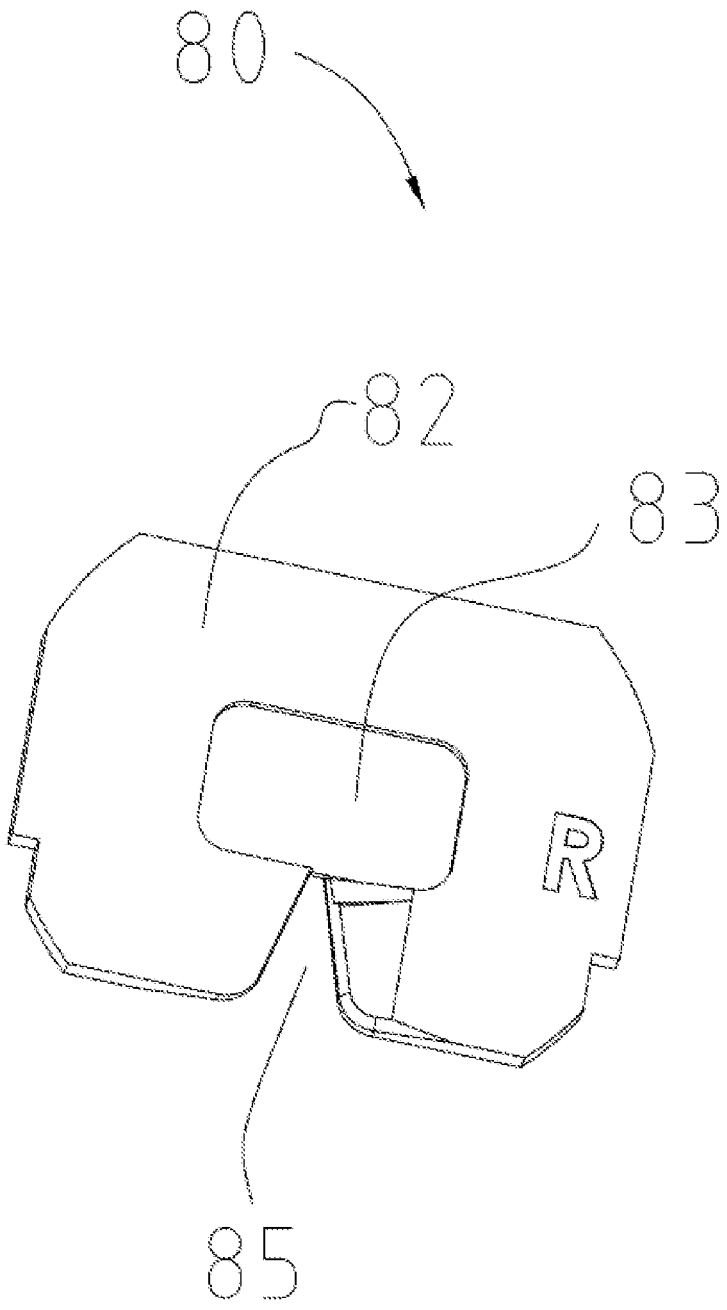
FIG. 6 is similar to FIG. 5, but viewed from another aspect.
Figure 7:
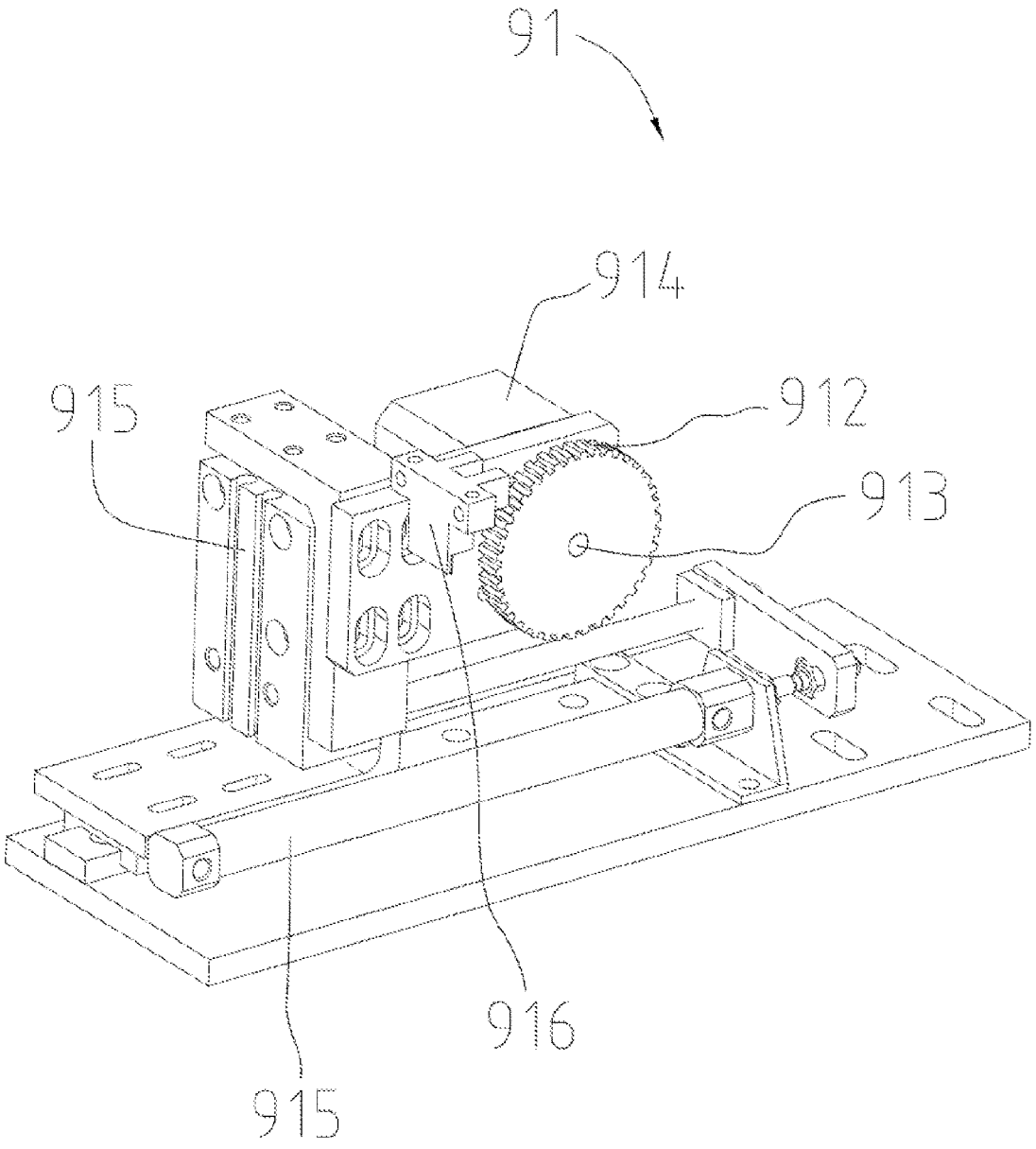
FIG. 7 is a perspective view of a positioning device of FIG. 1.
Figure 8:
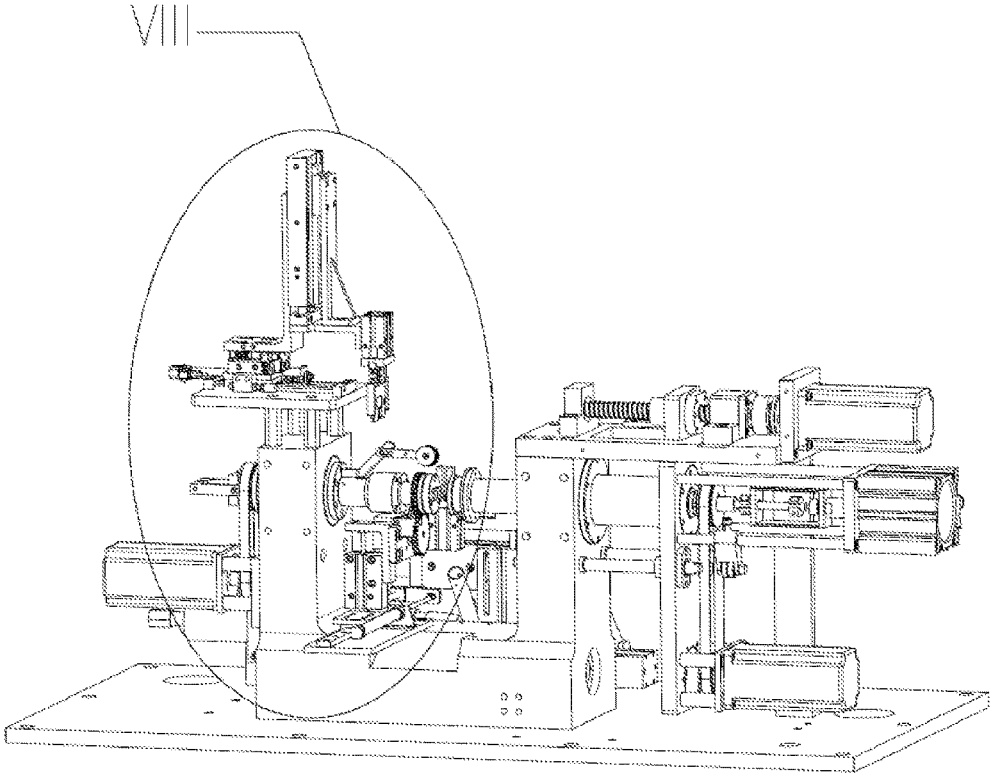
FIG. 8 is a part assembled view of a winding machine of FIG. 1.
Figure 9:
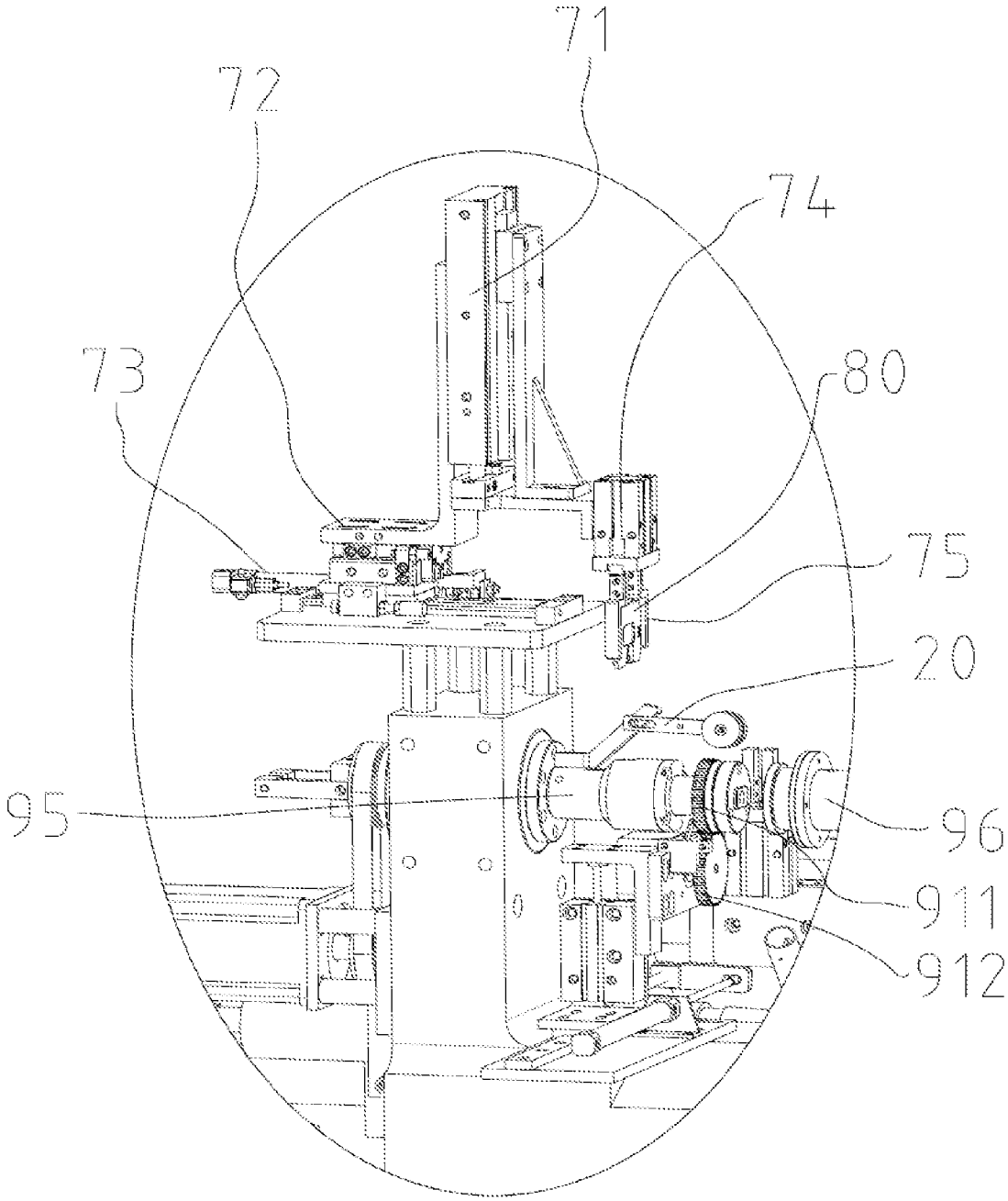
FIG. 9 is an enlarged view of an ellipse portion VIII of FIG. 8.
Figure 10:
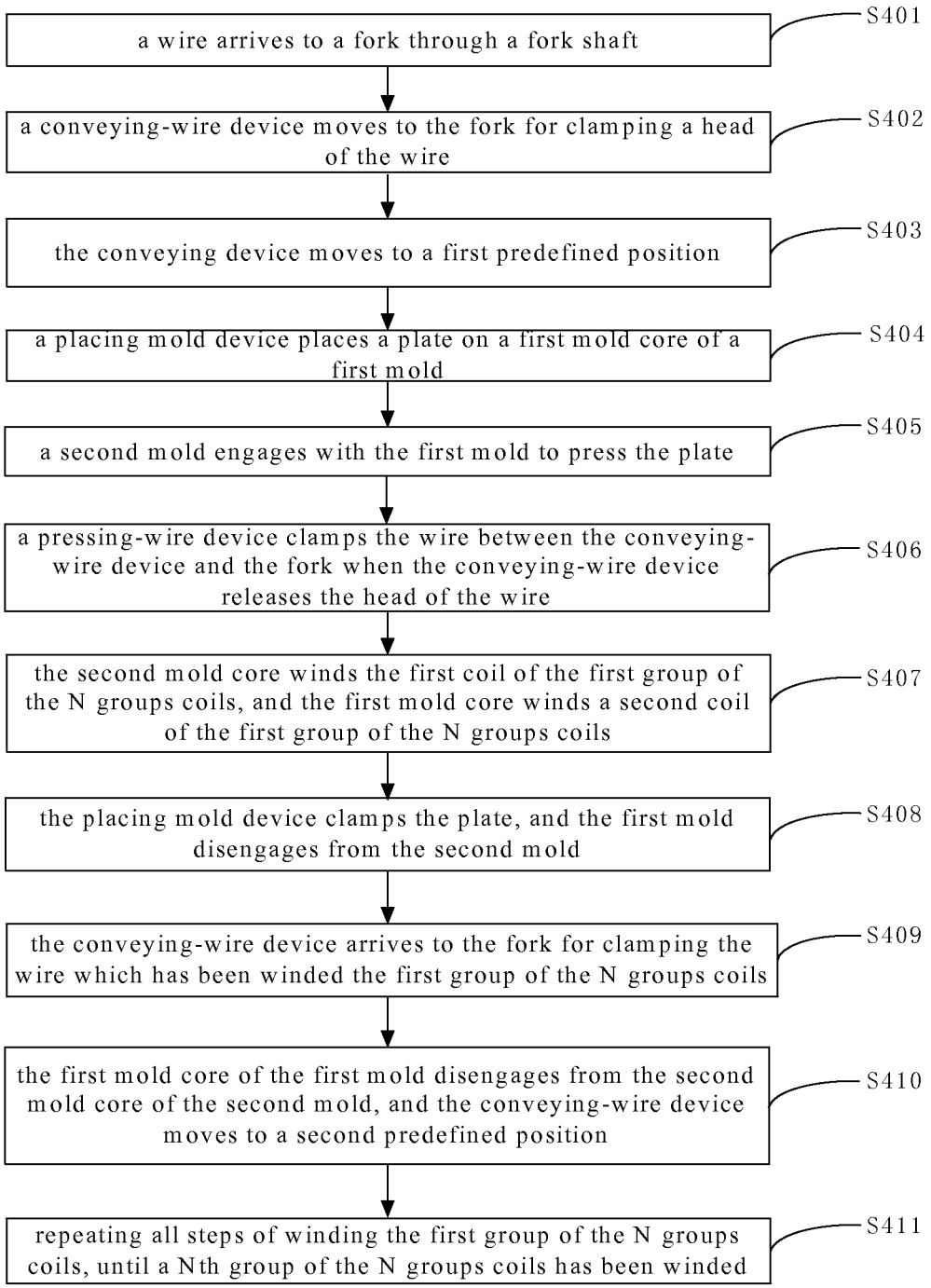
FIG. 10 is a flowchart of a winding method of the present invention.

Please referring to FIG. 2, FIG. 4, and FIG. 7, the positioning device 91 includes a first gear 911, a second gear 912, a positioning shaft 913, a positioning motor 914, a positioning cylinder 915 and a switch 916. The first gear 911 is disposed on the fork shaft 10, and the second gear 912 is disposed on the positioning shaft 913. The positioning motor 914 drives a rotation of the positioning shaft 913.

Please referring to FIG. 2, FIG. 4, and FIG. 7 to FIG. 9, the placing mold device 70 includes a first cylinder 71, a second cylinder 72, a third cylinder 73, a fourth cylinder 74 and a clamping portion 75. The clamping portion 75 is used for clamping the plate 80. The first cylinder 71 drives the clamping portion 75 to move up and down, and the second cylinder 72 drives the clamping portion 75 to move left and right, and the third cylinder 73 drives the clamping portion 75 to move forward and backward. After the second cylinder 72 drives the clamping portion 75 to move to a position between the first main shaft 95 and the second main shaft 96, the first cylinder 72 drives the clamping portion 75 to move down, and the third cylinder 73 makes the first groove 81 of the plate 80 accommodate the first mold core 52 while there is a gap between the plate 80 and the first mold core 52. The fourth cylinder 74 drives the clamping portion 75 to clamp or put down the plate 80.

During using, the second cylinder 72 of the placing mold device 70 drives the clamping portion 75 to move right to the position between the first mold 50 and the second mold 60, and the first cylinder 71 drives the clamping portion 75 to move down to make the first groove 81 of the plate 80 and the first mold core 52 be at the same height. The positioning motor 914 driven by the positioning cylinder 915 of the positioning device 91 moves to a position just below the fork shaft 10, and the positioning motor 914 drives the rotation of the second gear 912, then the positioning cylinder 915 moves up to make the first gear 911 and the second gear 912 engage and rotate synchronously. The first gear 911 drives the first mold 50 to rotate and make the direction of the first mold core 52 be identical to the direction of the first groove 81 of the plate 80. The third cylinder 73 moves left to place the plate 80 on the first mold core 52, and then the first mold 50 engages with the second mold 60 to press the plate 80. The fourth cylinder 74 drives to open the clamping portion 75 to put down the plate 80, then the placing mold device 70 and the positioning device 91 return to the starting position.

In one embodiment, the switch 916 is a U-shaped photoelectric switch.

Please referring to FIG. 2, the winding machine 100 includes a cutting-wire device 92, for cutting the wire 200 after the N groups coils has been winded.

Please referring to FIG. 1 and FIG. 2, the winding machine 100 also includes a first motor 93, a second motor 94, a clamping-mold motor 97 and a conveying-wire motor 98. The first motor 93 drives the first main shaft 95 to rotate, and the second motor 94 drives the second main shaft 96 to rotate, and the clamping-mold motor 97 drives the first mold 50 to engage with the second mold 60, and the conveying-wire motor 98 drives the conveying-wire device 30 to move. Simultaneously, the pressing-wire device 40 and the cutting-wire device 92 are both be driven by motors and cylinders.

Please referring to FIG. 1 to FIG. 9, during winding, the wire 200 arrives to the wire shaft 22 of the fork 20 through the threading orifice of the fork shaft 10. The conveying-wire motor 96 drives the conveying-wire device 30 to move to the fork 20 for clamping the head of the wire 200 and move opposite from the fork 20 to the first predefined position. The positioning device 91 drives the first mold 50 to rotate and makes the direction of the first mold core 52 be identical to the direction of the first groove 81 of the plate 80. The placing mold device 70 places the plate 80 on the first mold core 52 and makes a part of the first mold core 52 be accommodated in the first groove 81 of the plate 80. The clamping-mold motor 97 drives the second mold 60 to engage with the first mold 50 and makes a part of the second mold core 62 be accommodated in the second groove 83 of the plate 80, and then places the plate 80 on a position between the first mold core 52 and the second mold core 62. The placing mold device 70 places the plate 80 down and returns to a starting position, and the positioning device 90 also returns to a starting position. The conveying-wire device 30 releases the head of the wire 200 when the pressing-wire device 40 clamps the wire 200. The second motor 94 drives the second mold core 62 to wind one coil of a first group of the N groups coils, at the same time, the first motor 93 drives the first mold core 52 to wind another coil of the first group of the N groups coils with twice speed as the second mold core 62 in the same direction until the first group of the N groups coils has been winded. The clamping-mold motor 95 reverse rotate to make the first mold 50 disengages from the second mold 60 after the placing mold device 70 clamps the plate 80, and the placing mold device 70 clamps the plate 80 and returns to the starting position, and the conveying-wire device 30 clamps the wire 200 which has been winded the first group of the N groups coils from the fork 20. The first mold core 52 retracts in the first mold 50, at the same time, the second mold core 62 retracts in the second mold 60. The conveying-wire device 30 moves to a second predefined position, for preparing to wind a first coil and a second coil of next group of the N groups coils, until all the N groups coils have been winded.

In the present invention, the winding machine 100 can wind the first and the second coils simultaneously during winding the N groups coils, that is the first mold core 52 winds the first coil and the second mold core 62 winds the second coil simultaneously, and the first and the second coils are separated by the plate 80, thus increasing the efficiency of winding coils of the winding machine 100, and then solving inefficiencies caused by traditional winding machine 100 which is winding a single coil in one time. Moreover, the coils winded by the winding machine 100 of the present invention are connected together, which can be used in the transformer directly, rather than a plurality of single coils must be connected together for being used in the transformer, thus greatly improve the convenience of use for the user.

Furthermore, in the present invention, the conveying-wire device 30, the pressing-wire device 40, the placing mold device 70, the positioning device 91, the first mold 50, the second mold 60, the first main shaft 95 and the second main shaft 96 are all driven by motors and cylinders, and worker does not need to participate during the whole winding process, which greatly improve the convenience of use.

Please referring to FIG. 1 to FIG. 10, a method for winding N groups coils using the winding machine 100 of the present invention is introduced as following. Step 401, a wire 200 arrives to a fork 20 through a fork shaft 10. Step 402, a conveying-wire device 30 moves to the fork 20 for clamping a head of the wire 200. Step 403, the conveying device 30 moves to a first predefined position, wherein a distance between a starting position of the conveying-wire device 30 and the first predefined position is equal to a length of the wire 200 which is need for winding a first coil of a first group of the N groups coils, and wherein the starting position of the conveying-wire device 30 is a position the conveying-wire device 30 starts to move. Step 404, a placing mold device 70 places a plate 80 on a first mold core 52 of a first mold 50. Step 405, a second mold 60 engages with the first mold 50 to press the plate 80. Step 406, a pressing-wire device 40 clamps the wire 200 between the conveying-wire device 30 and the fork 20 when the conveying-wire device 30 releases the head of the wire 200. Step 407, the second mold core 62 winds the first coil of the first group of the N groups coils, and the first mold core 52 winds a second coil of the first group of the N groups coils. Step 408, the placing mold device 70 clamps the plate 80, and the first mold 50 disengages from the second mold 60. Step 409, the conveying-wire device 30 arrives to the fork 20 for clamping the wire 200 which has been winded the first group of the N groups coils. Step 410, the first mold core 52 of the first mold 50 disengages from the second mold core 62 of the second mold 60, and the conveying-wire device 30 moves to a second predefined position, wherein a distance between the starting position of the conveying-wire device 30 and the second predefined position is equal to a length of a wire 200 which is need for winding a first coil of a second group of the N groups coils. Step 411, repeating all steps of winding the first group of the N groups coils, until a Nth group of the N groups coils has been winded; wherein N is an integer greater than or equal to 1.

Because the winding method of the present invention can wind the first and the second coil simultaneously by using the first mold core 52 and the second mold core 62 during winding the N groups coils, and the first and the second coils are separated by the plate 80, thus increasing the efficiency of winding coils of the winding machine 100, and then solving inefficiencies caused by traditional winding machine 100 which is winding a single coil in one time. Moreover, the coils winded by the winding machine 100 of the present invention are connected together, which can be used in the transformer directly, rather than a plurality of single coils must be connected together for being used in the transformer, thus greatly improve the convenience of use for the user.

In one embodiment, the plate 80 includes a body 82, a first groove 81 and a second groove 83. The first groove 81 and the second groove 83 are disposed on the two opposite sides of the body 82 separately. A part of the first mold core 52 is accommodated in the first groove 81, and a part of the second mold core 62 is accommodated in the second groove 83. The first groove 81 and the second groove 82 are both circular, cross-sections of the first mold core 52 and the second mold core 62 are both circular.

In other embodiments, the first groove 81 and the second groove 83 are both square or other shapes, the cross-sections of the first mold core 52 and the second mold core 62 are both square or other shapes, that is, a shape of the first groove 81 is consistent with a cross-sectional shape of the first mold core 52, and a shape of the second groove 83 is consistent with a cross-sectional shape of the second mold core 62. As the first mold core 52 and the second mold core 62 are non-circular, a positioning device 91 positions the first mold core 52 before step 404, that is, as the first mold core 52 is non-circular, a outline of the first mold core 52 needs to be one-to-one corresponded with a outline of the first groove 81 to make the first mold core 52 be accommodated in the first groove 81, so the positioning device 91 is needed to position the first mold core 52 to make the outline of the first mold core 52 corresponding with the outline of the first groove 81, then the first mold core 52 is accommodated in the first groove 81.

In one embodiment, the correspondence of outlines between the second mold core 62 and the second groove 83 is realized by controller (not shown). As the second groove 83 and the second mold core 62 are non-circular, a outline of the second mold core 62 needs to be one-to-one corresponded with a outline of the second groove 83 to make the second mold core 62 be accommodated in the second groove 83, and the controller controls the outline of the second mold core 62 to make the second mold core 62 be accommodated in the second groove 83.

After the plate 80 is fixed, that is after step 406, the positioning device 91 and the placing mold device 70 return to a starting position.

In one embodiment, the rotate directions of the first mold core 52 and the second mold core 62 are the same, and the rotate speed of the first mold core 52 is twice the rotate speed of the second mold core 62, thus both the first and the second coils of each group can be winded synchronously and accurately.

Further, in order to reduce the distance between adjacent two groups of the N groups coils, that is, in order to reduce the length of the wire 200 between the adjacent two groups of the N groups coils, when winding a Kth group of the N groups coils, a (K−1)th group of the N groups coils arrives to the pressing-wire device 91 and the conveying-wire device 30 clamps the wire 200. After the pressing-wire device 91 opens and moves down, the conveying-wire device 30 moves forward until the Kth group of the N groups coils has been winded, wherein K is an integer greater than or equal to 2 and less than or equal to N.

Because the winding machine 100 of the present invention reduces the length of the wire 200 between the Kth group of the N groups coils and the (K−1)th group of the N groups coils, thus further reduces the cost.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A winding machine for winding N groups coils, comprising:

a conveying-wire device for clamping a wire and arriving to a first predefined position;

a pressing-wire device clamping the wire when the conveying-wire device releases the wires;

a first mold comprising a first mold core;

a plate;

a placing mold device for placing the plate on the first mold core or taking out the plate from the first mold core; and a second mold comprising a second mold core, wherein the second mold engages with or disengages from the first mold to press or release the plate;

wherein during winding, the second mold core winds a first coil of each group of the N groups coils, and the first mold core winds a second coil of each group of the N groups coils, and wherein the first mold core moves relative to the first mold to drop down each the second coil, and the second mold core moves relative to the second mold to drop down each the first coil, wherein N is an integer greater than or equal to 1.

2. The winding machine of claim 1, wherein the winding machine comprises a fork shaft and a fork, wherein during winding, the wire arrives to the fork through the fork shaft, and the conveying-wire device moves to the fork for clamping the wire and moves opposite from the fork to the first predefined position.

3. The winding machine of claim 2, wherein the winding machine comprises a first main shaft and a second main shaft, wherein the fork shaft is disposed on the first main shaft, and the first mold is rotatable disposed on the fork shaft, and wherein the second mold is disposed on the second main shaft, and the first mold core is disposed on the fork shaft, and the second mold core is disposed on the second main shaft.

4. The winding machine of claim 3, wherein the first mold core and the second mold core rotate in the same direction, and a rotate speed of the first mold core is twice a rotate speed of the second mold core.

5. The winding machine of claim 1, wherein the plate comprises a body, a first groove and a second groove, wherein the first groove and the second groove are disposed on two opposite sides of the body respectively, and wherein a part of the first mold core is accommodated in the first groove, and a part of the second mold core is accommodated in the second groove.

6. The winding machine of claim 5, wherein a shape of the first groove is consistent with a cross-sectional shape of the first mold core, and a shape of the second groove is consistent with a cross-sectional shape of the second mold core.

7. The winding machine of claim 5, wherein the plate has a wire groove, which is disposed on a lower end of the body and in communication with the first groove and the second groove.

8. The winding machine of claim 2, wherein the winding machine comprises a positioning device for positioning the first mold core, and wherein the positioning device comprises a first gear, a second gear, a positioning shaft and a positioning motor, wherein the first gear is disposed on the fork shaft, and the second gear is disposed on the positioning shaft and engages with the first gear, and wherein the positioning motor drives the rotation of the positioning shaft.

9. The winding machine of claim 8, wherein the positioning device comprises a positioning cylinder, wherein the positioning cylinder drives the positioning motor to move to a position just below the fork shaft, and the positioning motor drives the rotation of the second gear, and wherein the positioning cylinder moves up to make the first gear and the second gear engage and rotate synchronously.

10. The winding machine of claim 1, wherein the placing mold device comprises a first cylinder, a second cylinder, a third cylinder, a fourth cylinder and a clamping portion for clamping the plate, wherein the first cylinder drives the clamping portion to move up and down, and the second cylinder drives the clamping portion to move left and right, and wherein the third cylinder drives the clamping portion to move forward and backward, and the fourth cylinder drives the clamping portion to clamp or put down the plate.

11. The winding machine of claim 1, wherein the winding machine comprises a cutting-wire device, for cutting the wire after the N groups coils have been winded.

12. The winding machine of claim 3, wherein the winding machine comprises a first motor, a second motor, a clamping-mold motor and a conveying-wire motor, wherein the first motor drives the first main shaft to rotate, and the second motor drives the second main shaft to rotate, and wherein the clamping-mold motor drives the first mold to engage with the second mold, and the conveying-wire motor drives the conveying-wire device to move.

13. A winding method for winding N groups coils, comprising:

a conveying-wire device clamping a head of a wire and moving to a first predefined position;

a placing mold device placing a plate on a first mold core of a first mold;

a second mold engaging with the first mold to press the plate;

a pressing-wire device clamping the wire when the conveying-wire device releases the head of the wire;

the second mold core winding the first coil of the first group of the N groups coils, and the first mold core winding a second coil of the first group of the N groups coils;

the placing mold device clamping the plate, wherein the first mold disengages from the second mold;

the conveying-wire device clamping the wire which has winded the first group of the N groups coils;

the first mold core of the first mold disengaging from the second mold core of the second mold, wherein the conveying-wire device moves to a second predefined position; and repeating all steps of winding the first group of the N groups coils until a Nth group of the N groups coils has been winded;

wherein N is an integer greater than or equal to 1.

14. The winding method of claim 13, wherein before the conveying-wire device clamps the head of the wire, the wire arrives to a fork through a fork shaft, wherein the conveying-wire device moves to the fork and clamps the head of the wire.

15. The winding method of claim 13, wherein rotate directions of the first mold core and the second mold core are the same, and a rotate speed of the first mold core is twice a rotate speed of the second mold core.

16. The winding method of claim 15, wherein before the placing mold device places the plate on the first mold core of the first mold, a positioning device positions the first mold core.

17. The winding method of claim 16, wherein after the pressing-wire device clamps the wire when the conveying-wire device releases the head of the wire, the positioning device and the placing mold device return to a starting position.

18. The winding method of claim 13, wherein when winding a Kth group of the N groups coils, a (K−1)th group of the N groups coils arrives to the pressing-wire device and the conveying-wire device clamps the wire, wherein after the pressing-wire device opens and moves down, the conveying-wire device moves forward until the Kth group of the N groups coils has been winded, wherein K is an integer greater than or equal to 2 and less than or equal to N.

* * * * *